US010508321B2

(12) United States Patent
Watson et al.

(10) Patent No.: US 10,508,321 B2
(45) Date of Patent: Dec. 17, 2019

(54) AGE HARDENABLE DISPERSION STRENGTHENED ALUMINUM ALLOYS

(71) Applicant: United Technologies Corporation, Hartford, CT (US)

(72) Inventors: Thomas J. Watson, South Windsor, CT (US); Iuliana Cernatescu, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 280 days.

(21) Appl. No.: 15/022,514

(22) PCT Filed: Sep. 5, 2014

(86) PCT No.: PCT/US2014/054223

§ 371 (c)(1),
(2) Date: Mar. 16, 2016

(87) PCT Pub. No.: WO2015/041867

PCT Pub. Date: Mar. 26, 2015

(65) Prior Publication Data

US 2016/0230252 A1 Aug. 11, 2016

Related U.S. Application Data

(60) Provisional application No. 61/879,879, filed on Sep. 19, 2013.

(51) Int. Cl.
*C22C 1/04* (2006.01)
*B22F 3/14* (2006.01)
(Continued)

(52) U.S. Cl.
CPC ..... *C22C 1/0416* (2013.01); *B22F 3/24* (2013.01); *C22C 1/0491* (2013.01); *C22C 21/00* (2013.01);
(Continued)

(58) Field of Classification Search
CPC ..... C22C 1/0416; C22F 1/04
See application file for complete search history.

(56) References Cited

U.S. PATENT DOCUMENTS 5,532,069 A * 7/1996 Masumoto ..... C22C 1/0491 419/28
2010/0089506 A1 4/2010 Trenda

FOREIGN PATENT DOCUMENTS

DE 102007023323 A1 * 11/2008 ..... C22C 21/06
DE 102007023323 A1 11/2008
(Continued)

OTHER PUBLICATIONS

Davis, J.R.. (1993). ASM Specialty Handbook—Aluminum and Aluminum Alloys—9.8.1.4 Rolling. ASM International. (Year: 1993).*
(Continued)

*Primary Examiner* — Colleen P Dunn
*Assistant Examiner* — Jeremy C Jones
(74) *Attorney, Agent, or Firm* — Kinney & Lange, P.A.

(57) ABSTRACT

Dispersion strengthened aluminum-cerium-manganese alloys containing from about 0.05 to about 23.0 weight percent cerium and about 0.03 to about 9.5 weight percent manganese exhibit mechanical properties that make them useful alloys as a result of age hardening for extended periods at temperatures between 350° C. (662° F.) and 450° C. (842° F.).

16 Claims, 5 Drawing Sheets

(51) Int. Cl.

| | |
|---|---|
| ***B22F 3/20*** | (2006.01) |
| ***B22F 3/24*** | (2006.01) |
| ***C22C 21/00*** | (2006.01) |
| ***C22F 1/04*** | (2006.01) |

(52) U.S. Cl.
CPC ..... *C22F 1/04* (2013.01); *B22F 3/14* (2013.01); *B22F 3/20* (2013.01); *B22F 2998/10* (2013.01)

(56) References Cited

FOREIGN PATENT DOCUMENTS

| | | | | |
|---|---|---|---|---|
| EP | 0796925 | A1 | | 9/1997 |
| JP | 02034740 | A | * | 2/1990 |
| JP | H0234740 | A | | 2/1990 |
| JP | H05125474 | A | | 5/1993 |
| JP | H05156398 | A | | 6/1993 |
| JP | 06184712 | A | * | 7/1994 |
| JP | H06184712 | A | | 7/1994 |
| JP | 2002256264 | A | | 9/2002 |
| JP | 2002256364 | A | | 9/2002 |

OTHER PUBLICATIONS

Eckert, Jü, F. Schurack, and Ludwig Schultz. "Synthesis and Mechanical Properties of High Strength Aluminum-Based Quasicrystalline Composites." Journal of Metastable and Nanocrystalline Materials, vol. 15-16, 2003, pp. 245-252. ProQuest (Year: 2003).*

International Preliminary Report on Patentability dated Mar. 31, 2016, for corresponding PCT Application No. PCT/US2014/054223.

International Search Report and Written Opinion dated Sep. 5, 2014, for corresponding PCT Application No. PCT/US2014/054223.

Extended European Search Report, for European Patent Application No. 14846311.0, dated Mar. 10, 2017, 10 pages.

Communication Pursuant to Article 94(3) EPC for EP Application No. 14846311.0, dated Aug. 13, 2019, pp. 5.

* cited by examiner

AGE HARDENABLE DISPERSION STRENGTHENED ALUMINUM ALLOYS

BACKGROUND

Aluminum alloys are constantly being considered for fatigue critical applications in the aeropropulsion industry. Alloys such as 6061, 2024 or 7075 are well established and have been used for low temperature applications in both automotive and aerostructural applications for a long time. However, the useful temperature range for these materials is at or below 200° F. Attempts have been made to develop higher temperature aluminum based alloys including Al—Fe—Mo—V, Al—Fe—Si—V, and Al—Fe—Ce (hereafter referred to as "conventional dispersion strengthened materials"). These alloys have microstructures resulting in a good balance of properties at the subscale level. Unfortunately, their transition to a production scale resulted in a reduction of strength properties. This result was due to a number of factors, but was primarily driven by the need to go to higher temperatures during primary extrusion of consolidated precursor powder billets. The high temperatures required for primary extrusion of the conventional dispersion strengthened materials are a consequence of the fact that the strengthening second phase size is finest in the unextruded powder resulting in the material having the highest strength at that point. By going to higher temperatures, the strength can be lowered to allow commercial scale extrusion, but the higher temperatures can drive undesirable phase transformations and microstructural coarsening that lowers strength. Even when such phases do not transform, the longer heat up and soak times required for larger scale material production lead to coarsening of the strengthening phases and a concomitant lowering of the strength.

SUMMARY

Unlike the conventional dispersion strengthened materials, aluminum-cerium-manganese alloys containing from about 0.05 to 23.0 weight percent cerium and about 0.03 to about 9.5 weight percent manganese exhibit mechanical properties that make them useful alloys as a result of age hardening. That is, rather than starting out hard (or strong) as with conventional dispersion strengthened materials, these alloys start out soft, and then are aged, like heat treatable alloys, to have the desired strength properties.

In an embodiment, an age hardenable aluminum-cerium-manganese alloy, after gas-atomization, includes an aluminum solid solution containing a dispersion of the $Al_{20}CeMn_2$ phase. After aging, these alloys contain an aluminum solid solution plus $Al_{11}Ce_3$ and $Al_{12}Mn$.

These alloys exhibit an aging response after soaking at temperatures between 350° C. (662° F.) and 450° C. (842° F.).

DETAILED DESCRIPTION

The present disclosure relates to developing a class of aluminum alloys that are soft in powder form and are therefore easily extruded at low temperatures, but which can be aged to have higher elevated temperature strength after extrusion, or in the final product form after all hot working operations are complete.

Figure 1:
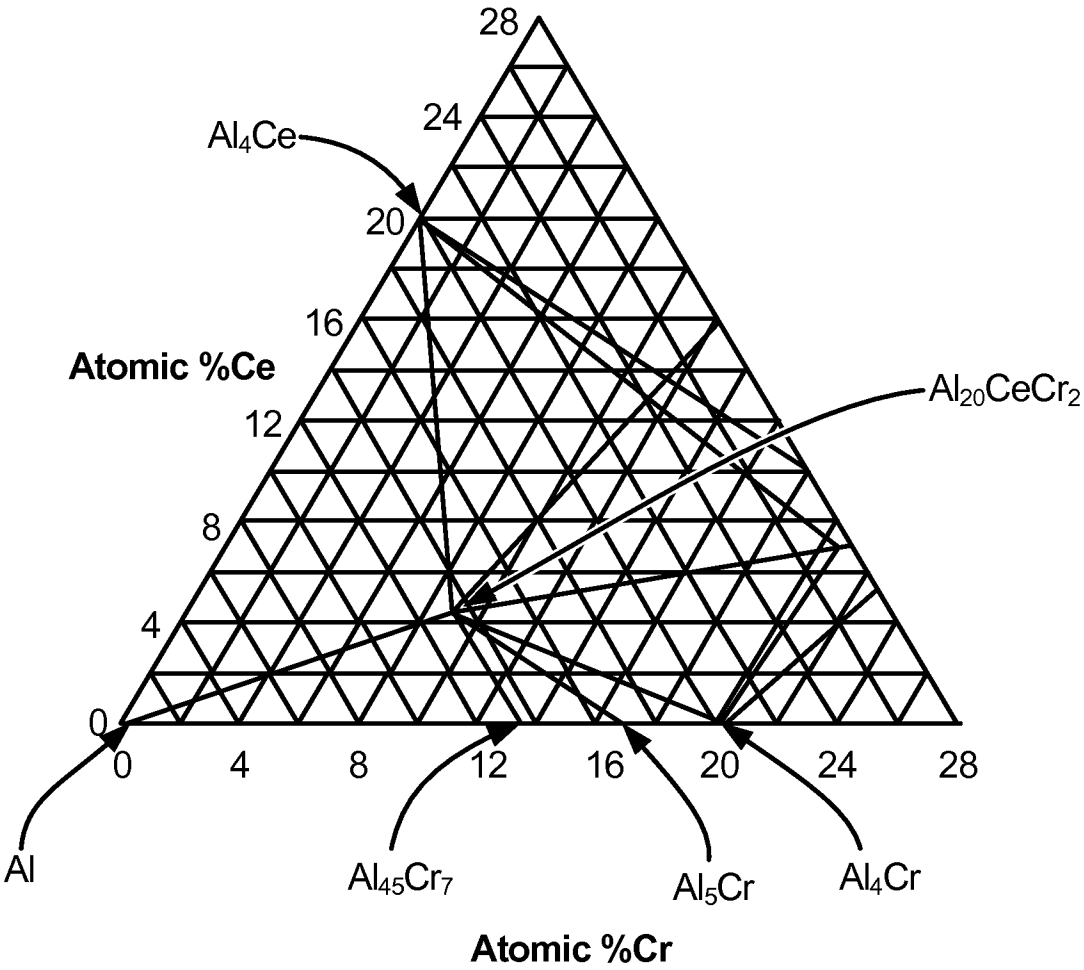
FIG. 1 is a 500° C. (932° F.) isothermal section of the aluminum-cerium-chromium ternary phase diagram.

The invention is based on a consideration of equilibrium phase diagrams for the aluminum-cerium-chromium and aluminum-cerium-manganese systems. A 500° C. isothermal section (isotherm) of the aluminum-cerium-chromium system is shown in FIG. 1. It is apparent that the aluminum rich corner of the aluminum-cerium-chromium diagram contains two three-phase regions, namely the Al—$Al_{45}Cr_7$—$Al_{20}CeCr_2$ region and the Al—$Al_4Ce$—$Al_{20}CeCr_2$ region. This system is interesting from a microstructural design standpoint in that very little solute (Ce and Cr additions) is needed to obtain a high volume fraction of a second phase. With reference to the pseudo-binary between Al and $Al_{20}CeCr_2$, it is apparent that a low atomic percentage of solute is needed to obtain a high atomic fraction (and therefore volume fraction) of $Al_{20}CeCr_2$.

Figure 2:
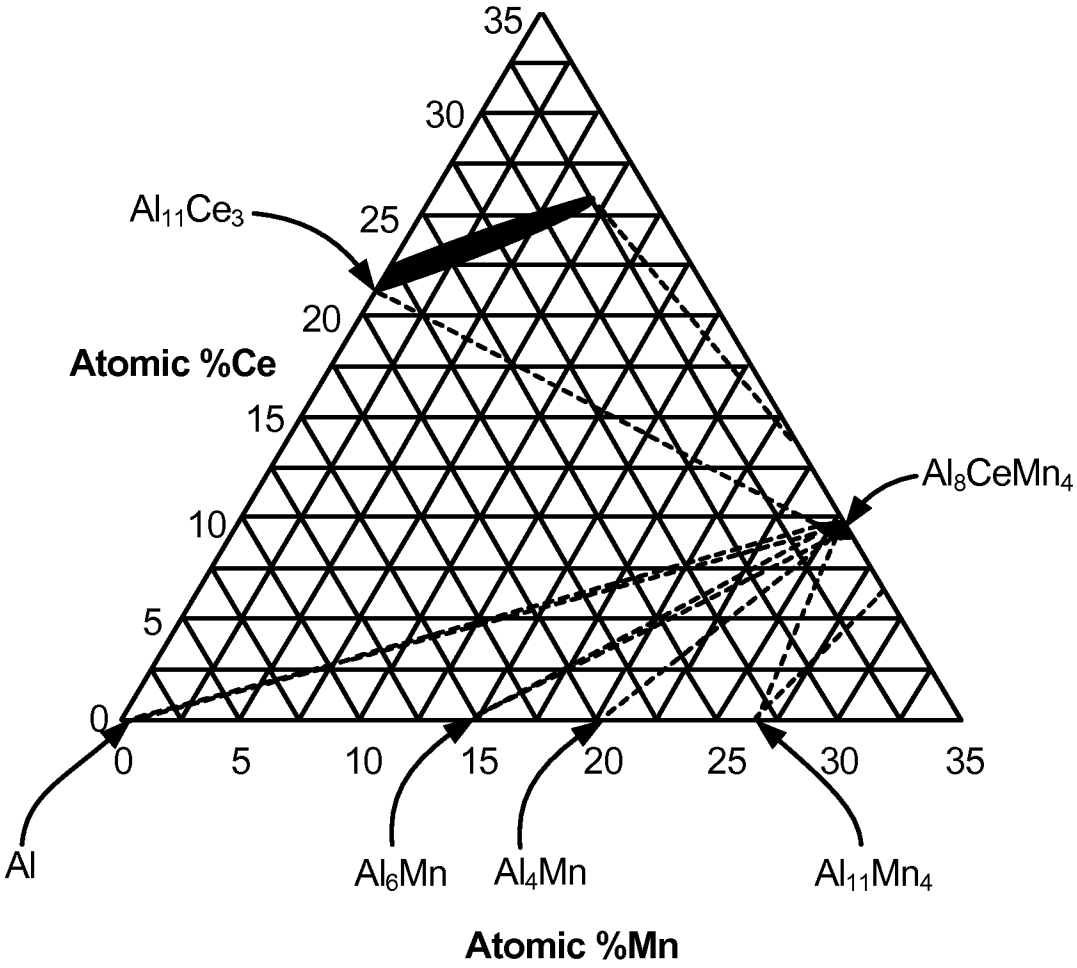
FIG. 2 is a 500° C. (932° F.) isothermal section of the aluminum-cerium-manganese ternary phase diagram.

The aluminum-cerium-manganese system of interest for the present invention is shown in FIG. 2. The system has useful similarities to the aluminum-cerium-chromium system as will be shown.

With reference to FIG. 2, it can be seen that the aluminum rich corner of the aluminum-cerium-manganese diagram also has two three-phase regions; namely, the Al—$Al_6Mn$—$Al_8CeMn_4$ region and Al—$Al_{11}Ce_3$—$Al_8CeMn_4$ region. The $Al_8CeMn_4$ phase is not as close to the aluminum corner as the $Al_{20}CeCr_2$ phase in FIG. 1. It should also be noted that the $Al_{20}CeMn_2$ phase does not appear as an equilibrium phase on the aluminum-cerium-manganese phase diagram in FIG. 2. However, as mentioned above, this phase is the only phase present after atomization, and this is likely due to the similarities between Cr and Mn and the rapid solidification of the melt. Hence, the phase would not be obtained unless this family of alloys are rapidly solidified. This then, sets the stage for the phase transformations described further below.

Figure 3:
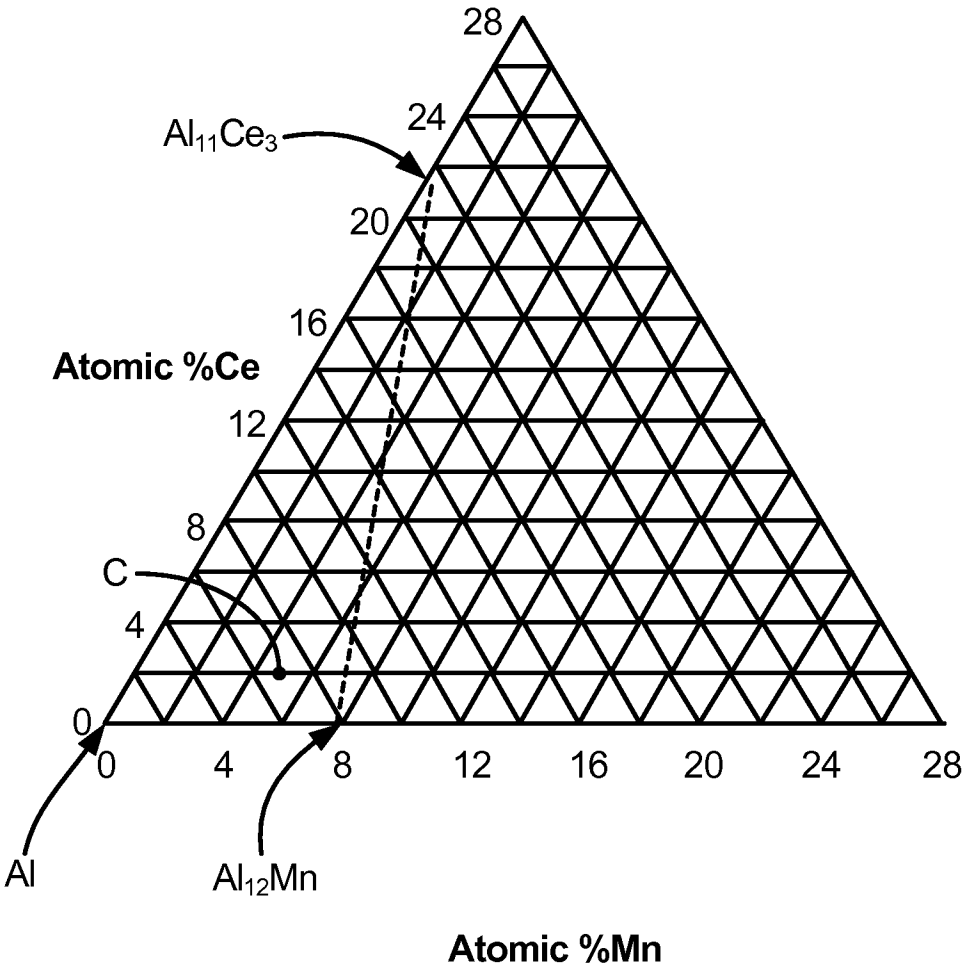
FIG. 3 is a 450° C. (842° F.) isothermal section of the aluminum-cerium-manganese ternary phase diagram.

In an embodiment, an experimental Al-2.0Ce-5.0Mn (atomic percent) alloy close to the aluminum corner of the ternary diagram was prepared. A 450° C. (842° F.) isotherm of the aluminum-cerium-manganese ternary diagram is shown in FIG. 3. The composition of the inventive alloy is indicated by C. As discussed below, equilibrium $Al_{11}Ce_3$ and metastable $Al_{12}Mn$ are phases that play prominent roles in the invention. The alloy was prepared using gas atomization, powder consolidation and extrusion to form a billet. The billet was sectioned into samples that were then subjected to aging anneals at temperatures up to 500° C. (932° F.).

A preferred method of making the alloy of the present invention is discussed below.

Step 1. Gas atomization of powder. Materials may be placed in a crucible and atomized to form powder particles. The cooling rate is preferably greater than $10^{3}$° C. per second. Atomization may be preferably conducted at a pressure of at least 120-150 psi, and preferably at least 200 psi. One may use a gas content of 85 percent He-15 percent argon or other inert gas. An ideal gas content is 100 percent helium.

Step 2. Vacuum hot pressing of powder into billet. The powder is poured into an aluminum container and the container evacuated. The container may be heated to a temperature of 300 to 400° C. (572 to 752° F.). Pressure may be applied in the range of 10 ksi to 100 ksi.

Step 3. Extrude billet into bar stock. The billet from Step 2 may be extruded into bar stock at a temperature of 350 to 500° C. (662 to 932° F.). The extrusion ratio may be preferably greater than 10:1 for better material behavior and preferably from 10:1 to 25:1.

Figure 4:
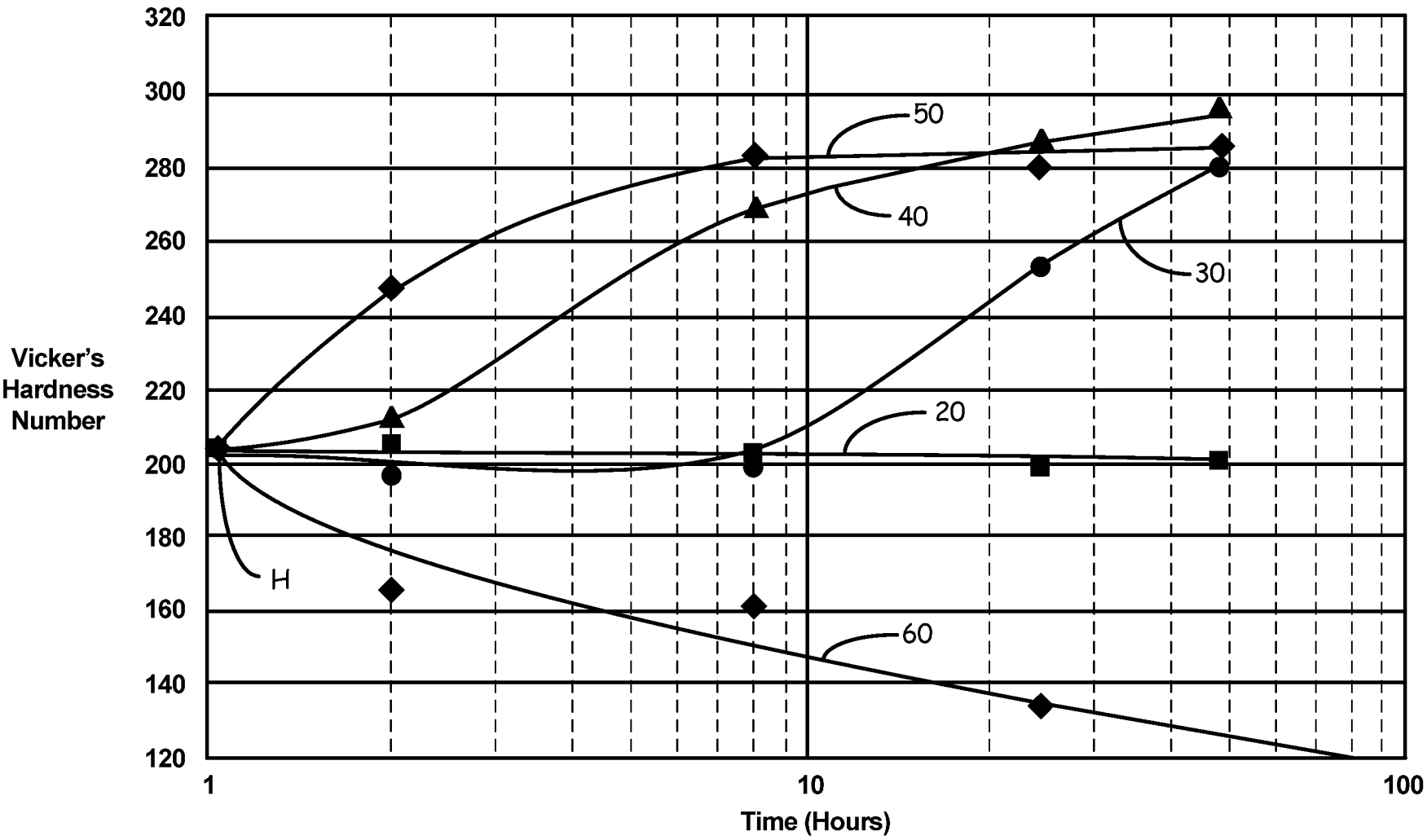
FIG. 4 shows aging curves showing hardness as a function of time at various temperatures for an aluminum-cerium-manganese alloy of the invention.

For the aging study, samples were cut from the billet and aged for up to 48 hours at temperatures up to 500° C. (932° F.). Vickers hardness measurements were made on samples soaked for 1, 2, 8, 24, and 48 hours. The results are shown as hardness versus aging time in FIG. 4. The initial hardness is indicated to the left of the figure by the letter H. The aging temperatures and corresponding number for each curve in FIG. 4 are as follows:

| Curve Number | Aging Temperature |
|---|---|
| 20 | 300° C. (572° F.) |
| 30 | 350° C. (662° F.) |
| 40 | 400° C. (752° F.) |
| 50 | 450° C. (842° F.) |
| 60 | 500° C. (932° F.) |

Samples aged at temperatures at or greater than 350° C. (662° F.) showed aging and a resulting increase in hardness. Hardnesses reached a peak and leveled off after about 10 hours at 400° C. (752° F.) and 450° C. (842° F.). A 500° C. (932° F.) aging temperature softened the alloy.

Figure 5:
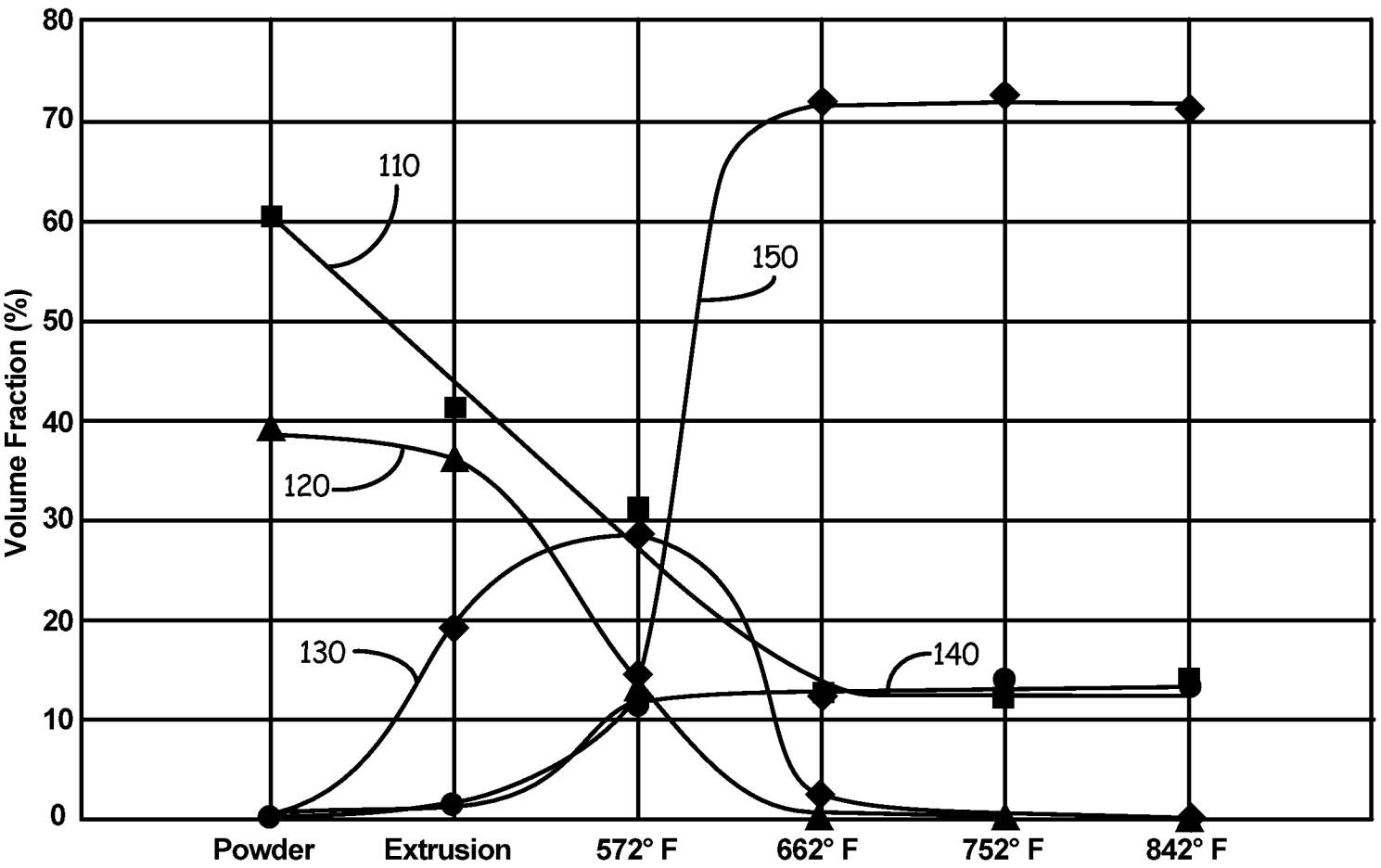
FIG. 5 is a plot showing the volume fraction of microstructural features formed during the aging treatments in each sample shown in FIG. 4.

To provide insight into what is causing the increase in hardness, a plot of the volume fraction for each phase present after processing, and after 48 hours at each aging temperature is shown in FIG. 5. The aging curve numbers and corresponding phases are as follows:

| Curve Number | Phase |
|---|---|
| 110 | Al |
| 120 | $Al_{20}CeMn_2$ |
| 130 | $Al_6Mn$ |
| 140 | $Al_{11}Ce_3$ |
| 150 | $Al_{12}Mn$ |

The phase content at the different stages shown in FIG. 5 is as follows:

| | |
|---|---|
| As Formed Powder | $Al_{20}CeMn_2$ |
| Extruded billet | $Al_{20}CeMn_2$, $Al_6Mn$ |
| 300° C. (572° F.) aged billet | $Al_{20}CeMn_2$, $Al_6Mn$, $Al_{11}Ce_3$, $Al_{12}Mn$ |
| 400° C. (752° F.) aged billet | $Al_{11}Ce_3$, $Al_{12}Mn$ |

The study showed $Al_{20}CeMn_2$ formed during the initial powder formation and was gone after a 48-hour heat treatment at 400° C. (752° F.). $Al_6Mn$ formed during the extrusion and was gone after 48 hours at 400° C. (752° F.). $Al_{11}Ce_3$ and $Al_{12}Mn$ formed during the aging and were present after 48 hours at 400° C. (752° F.). The results indicate that the inventive alloy is age hardenable and that the strengthening of $Al_{12}Mn$ and $Al_{11}Ce_3$ are stable at temperatures at and above (350° C.) 662° F.

The above microstructural analysis shows $Al_{12}Mn$ and $Al_{11}Ce_3$ as stable phases in the microstructure. This suggests use of the "metastable" phase diagram shown in FIG. 3. The diagram shows a 450° C. (842° F.) isotherm of the aluminum-cerium-manganese phase diagram. The three phase field in the aluminum rich corner of the phase diagram consists of Al—$Al_{11}Ce_3$—$Al_{12}Mn$ in quasi-equilibrium. As noted earlier, the proximity of $Al_{12}Mn$ and $Al_{11}Ce_3$ to the aluminum corner allows large amounts of second phase to be formed with relatively small amounts of solute additions. As evidenced in FIG. 5, the $Al_{12}Mn$ is present in an amount of 70 volume percent. The inventive composition used for these studies is shown by point C in the diagram of FIG. 3.

During the heat treatment, the $Al_{20}CeMn_2$ dissolves and is almost gone after 48 hours at (350° C.) 662° F. $Al_6Mn$ in the extruded billet is also almost gone after 48 hours at the same temperature.

Precipitation of the intermetallic compounds $Al_{12}Mn$ and $Al_{11}Ce_3$ result in age hardening as shown in FIG. 4. The aging curves showing the Vickers hardness as a function of time at each aging temperature show the alloys of the present invention are age hardenable at temperatures greater than (350° C.) 662° F. after 10 hours, but less than (500° C.) 932° F., which results in an immediate loss of hardness.

The composition range for the alloys of the present invention may be found on the aluminum-cerium-manganese phase diagram in FIG. 3. Converting the atomic percent in the phase diagram to weight percent, the cerium may be in amounts ranging from 0.05 to about 23.0 weight percent. Preferably, the cerium may be in amounts of from 0.10 to about 10.0 weight percent. The manganese may be in amounts ranging from 0.03 to about 9.5 weight percent. Preferably the manganese may be in amounts from about 0.05 to about 4.0 weight percent.

In an embodiment, the manganese to cerium ratio (using atomic %) may range from about 0.1 to about 10.0. Preferably the ratio may be from about 1.0 to about 3.0.

The aging heat treatment temperatures may be between about (350° C.) 662° F. to about 500° F. (932° C.). Preferably the heat treatment temperatures may be between about (350° C.) 662° F. and about (450° C.) 842° F. The aging times may vary between 1 and 100 hours. Preferably the times are between about 1 and 48 hours.

Discussion of Possible Embodiments

The following are non-exclusive descriptions of possible embodiments of the present invention.

An age hardenable aluminum-cerium-manganese alloy may comprise about 0.05 to about 23.0 weight percent cerium; about 0.03 to about 9.5 weight percent manganese; and the balance substantially aluminum.

The system of the preceding paragraph can optionally include, additionally and/or alternatively any, one or more of the following features, configurations and/or additional components:

About 0.1 to about 10.0 weight percent cerium; about 0.5 weight percent manganese to about 4.0 weight percent manganese; and the balance substantially aluminum.

The manganese to cerium ratio may be between about 0.1 to about 10.0.

The alloy may be formed by rapid solidification processing.

The alloy may comprise an aluminum solid solution matrix containing a plurality of $Al_{12}Mn$, $Al_{11}Ce_3$, $A_{16}Mn$, and $Al_{20}CeMn_2$ as dispersed second phases.

The alloy may comprise an aluminum matrix containing a plurality of $Al_{12}Mn$ and $Al_{11}Ce_3$ following a heat treatment.

The aging temperatures may be from about 300° C. (572° F.) to about 500° C. (932° F.).

The aging temperatures may be from about 350° C. (662° F.) to about 450° C. (842° F.).

The aging times may be from about 1 hour to about 100 hours.

The aging times may be from about 1 hour to about 48 hours.

An age hardenable aluminum-cerium-manganese alloy may comprise aluminum solid solution; dispersed $Al_{11}Ce_3$ second phase; and dispersed $Al_{12}Mn$ phase.

The alloy of the preceding paragraph can optionally include, additionally and/or alternatively, any, one or more of the following features, configurations and/or additional components:

The alloy may have an operating temperature of between room temperature and 450° C. (842° F.). The alloy may comprise about 0.05 to about 23.0 weight percent cerium; about 0.03 to about 9.5 weight percent manganese; and the balance substantially aluminum.

The manganese to cerium ratio may be between about 0.1 to about 10.0.

The Vickers hardness at 450° C. (842° F.) may be between 40 and 300. The alloy may be formed by rapid solidification.

The aging temperatures may be from about 300° C. (662° F.) to about 500° C. (932° F.).

The aging temperatures may be from about 350° C. (662° F.) to about 450° C. (842° F.).

A method of forming an age hardenable aluminum-cerium-manganese alloy may comprise: gas atomization to form powder wherein cooling is greater than $10^{3}$° C. per second; vacuum hot pressing powder to form billet; and extruding billet into bar stock.

The method of the preceding paragraph can optionally include, additionally and/or alternatively, any, one or more of the following features, configurations and/or additional components:

The age hardenable aluminum-cerium-manganese alloy composition, may comprise: about 0.05 to about 23.0 weight percent cerium; about 0.03 to about 9.5 weight percent manganese; and the balance substantially aluminum.

Although the present invention has been described with reference to preferred embodiments, workers skilled in the art will recognize that changes may be made in form and detail without departing from the spirit and scope of the invention.

The invention claimed is:

1. Age hardened aluminum-cerium-manganese alloy capable of experiencing an increase in hardness after being heated to an aging temperature for an aging time, consisting of:

0.05 to 23.0 weight percent cerium;

0.03 to 9.5 weight percent manganese; and the balance aluminum;

wherein the alloy is formed by gas atomization of powder with a rapid solidification process and aging at a temperature from 300° C. (572° F.) to 500° C. (932° F.) and the alloy comprises an aluminum solid solution matrix containing a plurality of $Al_{12}Mn$, $Al_{11}Ce_3$, $Al_6Mn$, and/or $Al_{20}CeMn_2$ as dispersed second phases at various stages of processing and age hardening of the alloy wherein the alloy comprises 70 volume percent $Al_{12}Mn$ after aging.

2. The alloy of claim 1 consisting of:

0.1 to 10.0 weight percent cerium;

0.5 to 4.0 weight percent manganese; and the balance aluminum.

3. The alloy of claim 1 wherein the manganese to cerium ratio is between 0.1 to 10.0.

4. The alloy of claim 3 wherein the alloy comprises an aluminum matrix containing a plurality of $Al_{12}Mn$ and $Al_{11}Ce_3$ following a heat treatment.

5. The alloy of claim 1 wherein the aging temperature is from 350° C. (662° F.) to 450° C. (842° F.).

6. The alloy of claim 1 wherein the aging times is from 1 hour to 100 hours.

7. The alloy of claim 6 wherein the aging times is from 1 hour to 48 hours.

8. Age hardened aluminum-cerium-manganese alloy capable of experiencing an increase in hardness after being heated to an aging temperature for an aging time, consisting of:

aluminum solid solution;

dispersed $Al_{11}Ce_3$ second phase; and dispersed $Al_{12}Mn$ phase;

wherein the alloy is formed by gas atomization with a rapid solidification process and aging at a temperature from 300° C. (572° F.) to 500° C. (932° F.) such that the alloy comprises 70 volume percent $Al_{12}Mn$ after aging.

9. The alloy of claim 8 wherein the alloy has an operating temperature of between room temperature and 450° C. (842° F.).

10. The alloy of claim 8 wherein the alloy consists of:

0.05 to 23.0 weight percent cerium;

0.03 to 9.5 weight percent manganese; and the balance aluminum.

11. The alloy of claim 10 wherein the ratio of manganese to cerium is between 0.1 to 10.0.

12. The alloy of claim 8 wherein the Vickers hardness at 450° C. (842° F.) is between 40 and 300.

13. The alloy of claim 8 wherein the aging temperature is from 350° C. (662° F.) to 450° C. (842° F.).

14. The alloy of claim 8 wherein the aging temperature is from 350° C. (662° F.) to 450° C. (842° F.).

15. A method of forming an age hardened aluminum-cerium-manganese alloy wherein the age hardened aluminum-cerium-manganese alloy composition consists of:

0.05 to 23.0 weight percent cerium;

0.03 to 9.5 weight percent manganese; and the balance aluminum; and the method comprising:

gas atomization to form powder with cooling greater than $10^{3}$° C. per second;

vacuum hot pressing powder to form a billet;

extruding the billet into bar stock; and age hardening the billet an aging temperature from 300° C. (572° F.) to 500° C. (932° F.) for an aging time such that the alloy comprises 70 volume percent $Al_{12}Mn$ after aging.

16. The method of claim 15 wherein the aging temperature is from 350° C. (662° F.) to 450° C. (842° F.).

* * * * *